US008648768B2

(12) United States Patent
Mussler

(10) Patent No.: US 8,648,768 B2
(45) Date of Patent: Feb. 11, 2014

(54) CONICAL SWITCHED BEAM ANTENNA METHOD AND APPARATUS

(75) Inventor: Michael E. Mussler, Nederland, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 372 days.

(21) Appl. No.: 13/018,146

(22) Filed: Jan. 31, 2011

(65) Prior Publication Data

US 2012/0194386 A1 Aug. 2, 2012

(51) Int. Cl.
*H01Q 3/24* (2006.01)
*H01Q 19/06* (2006.01)

(52) U.S. Cl.
USPC ..... 343/876; 343/753; 343/754

(58) Field of Classification Search
USPC ..... 343/700 MS, 873, 753, 754, 876; 342/368, 372
See application file for complete search history.

(56) References Cited

U.S. PATENT DOCUMENTS

| | | | |
|---|---|---|---|
| 3,090,956 | A | 5/1963 | Woodward, Jr. et al. |
| 3,116,485 | A | 12/1963 | Carson |
| 3,569,976 | A | 3/1971 | Korvin et al. |
| 3,775,773 | A | 11/1973 | Nemit |
| 3,887,926 | A | 6/1975 | Schwartz et al. |
| 4,127,857 | A | 11/1978 | Capps et al. |
| 4,359,738 | A | 11/1982 | Lewis |
| 4,423,422 | A | 12/1983 | Knop et al. |
| 4,630,062 | A | 12/1986 | Dewey |
| 4,673,943 | A | 6/1987 | Hannan |
| 4,825,222 | A | 4/1989 | Butcher |
| 4,890,117 | A | 12/1989 | de Ronde |
| 5,023,594 | A | 6/1991 | Wallace |
| 5,202,697 | A | 4/1993 | Bonebright et al. |
| 5,506,592 | A | 4/1996 | MacDonald et al. |
| 5,714,964 | A | 2/1998 | Jackson |
| 5,742,257 | A | 4/1998 | Hadden et al. |
| 6,023,246 | A | 2/2000 | Tanabe |
| 6,104,346 | A | 8/2000 | Rudish et al. |
| 6,317,096 | B1 | 11/2001 | Daginnus et al. |
| 6,353,418 | B1 | 3/2002 | Burger et al. |
| 6,384,795 | B1 | 5/2002 | Bhattacharyya et al. |
| 6,452,565 | B1 * | 9/2002 | Kingsley et al. ..... 343/873 |

(Continued)

FOREIGN PATENT DOCUMENTS

| | | | |
|---|---|---|---|
| DE | 27 14 643 | A1 | 2/1978 |
| EP | 0 456 034 | A2 | 11/1991 |

(Continued)

OTHER PUBLICATIONS

Inoue et al., "Horn-Array Type Electrically Despun Antenna for the 11-GHz Band", Electronics and Communications in Japan, vol. 53-B, No. 7, 1970, 8 pages.

(Continued)

*Primary Examiner* — Hoang V Nguyen
(74) *Attorney, Agent, or Firm* — Sheridan Ross P.C.

(57) ABSTRACT

A switched beam antenna system is provided. The antenna system includes a plurality of feed elements arranged radially about a center point. A feed switch provides equidistant signal paths between each antenna element and a transceiver. The production of an antenna beam in a desired direction is achieved by controlling a switch to selectively operate a feed element associated with a beam coverage area that encompasses the desired steering angle.

12 Claims, 10 Drawing Sheets

(56) References Cited

U.S. PATENT DOCUMENTS

| | | | | |
|---|---|---|---|---|
| 6,816,118 | B2 * | 11/2004 | Kingsley et al. | 343/700 MS |
| 6,900,764 | B2 * | 5/2005 | Kingsley et al. | 343/700 MS |
| 6,987,489 | B2 | 1/2006 | Melconian et al. | |
| 7,012,572 | B1 | 3/2006 | Schaffner et al. | |
| 7,081,858 | B2 | 7/2006 | Miles | |
| 7,307,596 | B1 | 12/2007 | West | |
| 7,728,772 | B2 | 6/2010 | Mortazawi et al. | |
| 2002/0167449 | A1 | 11/2002 | Frazita et al. | |
| 2003/0052831 | A1 | 3/2003 | Knop et al. | |
| 2004/0085249 | A1 | 5/2004 | Kitamori et al. | |
| 2005/0200531 | A1 | 9/2005 | Huang et al. | |
| 2005/0219126 | A1 | 10/2005 | Rebeiz et al. | |
| 2006/0071876 | A1 | 4/2006 | Clymer et al. | |
| 2007/0252768 | A1 | 11/2007 | Mohamadi | |
| 2008/0055175 | A1 | 3/2008 | Rebeiz et al. | |
| 2008/0100523 | A1 | 5/2008 | Kim et al. | |
| 2008/0117113 | A1 | 5/2008 | Haziza | |
| 2009/0237318 | A1 | 9/2009 | Brown | |
| 2009/0267852 | A1 | 10/2009 | Tahmisian, Jr. et al. | |
| 2009/0309801 | A1 | 12/2009 | Rao et al. | |
| 2010/0013726 | A1 | 1/2010 | Matthews et al. | |
| 2010/0052987 | A1 | 3/2010 | Weinstein | |
| 2010/0066590 | A1 | 3/2010 | Brown et al. | |
| 2010/0164784 | A1 | 7/2010 | Longstaff | |
| 2010/0207819 | A1 | 8/2010 | Uhl et al. | |

FOREIGN PATENT DOCUMENTS

| | | | |
|---|---|---|---|
| GB | 1011303 | | 11/1965 |
| GB | 1505375 | | 3/1978 |
| GB | 2258345 | A | 2/1993 |
| GB | 2 355 855 | A | 5/2001 |
| JP | 2000 138521 | A | 5/2000 |
| WO | WO 00/01031 | A1 | 1/2000 |
| WO | WO 00/76028 | A1 | 12/2000 |
| WO | WO 01/28162 | A1 | 4/2001 |
| WO | WO 01/69720 | A1 | 9/2001 |
| WO | WO 03/098740 | A1 | 11/2003 |

OTHER PUBLICATIONS

International Search Report and Written Opinion for International Application No. PCT/US2011/060564, mailed Mar. 6, 2012, 16 pages.

International Search Report and Written Opinion for International Application No. PCT/US2011/060571, mailed Feb. 29, 2012, 12 pages.

Stutzke, Nathan A., U.S. Appl. No. 13/018,145, Entitled "Continuous Horn Circular Array Antenna System", filed Jan. 31, 2011, 36 pages.

International Preliminary Report on Patentability for International Application No. PCT/US2011/060571, mailed Aug. 6, 2013, 7 pages.

* cited by examiner

CONICAL SWITCHED BEAM ANTENNA METHOD AND APPARATUS

FIELD

A switched beam antenna and method of providing and operating a switched beam antenna that is steerable in a first plane is provided.

BACKGROUND

Many communication systems require a low profile aperture antenna that can be easily conformed to an existing structure, such as the skin of an aircraft, or concealed beneath a surface, that can be used on a moving vehicle, and that can provide a steered beam. In the past, monolithic microwave integrated circuit (MMIC) or other electronically scanned or steered planar phased arrays have been used for such applications because they provide a low profile aperture. The usual reasons why an electronic phased array may be selected for a particular application include the phased array's ability to provide high speed beam scanning and meet multi-beam/multi-function requirements.

Unfortunately, there are several disadvantages associated with implementing an electronically steered phased array. The most notable disadvantage is that electronically steered phased arrays are very costly, since the amplitude and phase at each point in the aperture is controlled discretely. The active circuit elements required to operate such an array are complex, costly and susceptible to failure. As a result, commercial exploitation of electronically steered phased arrays has been limited. Instead, the use of electronically steered phased arrays is generally confined to applications where minimizing cost is not necessarily of the highest priority. However, for most commercial applications mitigating costs is a high priority when implementing antennas or other devices.

An alternative to electronically steered phased array antennas is a mechanically steered antenna. Mechanically steered antennas include directional antennas, such as dishes, that are mechanically moved so that they point towards the endpoint that they are exchanging communications with. Other examples of mechanically steered antennas include antennas with beams that can be steered by rotating one or more lenses that intersect the antenna's beam. However, directional antennas that are mechanically steered often have a relatively high profile, and are therefore unsuitable for applications requiring a low-profile antenna. An antenna with a mechanically steered lens assembly can suffer from increased losses due to the inclusion of the lens elements and, like other systems that include mechanically steered components, can be prone to mechanical failure.

Still another alternative is to substitute an antenna with a higher gain omnidirectional azimuth plane pattern for an antenna with a beam that can be steered. However, many antenna designs that produce a suitable omnidirectional azimuth plane pattern have a relatively high profile and reduced coverage in the elevation plane. In addition, the gain of such systems for a particular antenna size or configuration can be inadequate for certain applications. Moreover, for particular applications, it may be undesirable to utilize an omnidirectional beam pattern.

SUMMARY

The present invention is directed to solving these and other problems and disadvantages of the prior art. In accordance with embodiments of the present invention, an antenna system featuring a disk-shaped dielectric and a plurality of feeds is provided. More particularly, an antenna system with a plurality of feeds arranged radially about a center point is provided. A feed switch at the center point can be operated to interconnect a selected feed or feeds to a radio frequency bus. Through the selective interconnection of one or more of the feeds to the radio frequency bus, the beam of the antenna system can be steered in azimuth about the antenna system.

In accordance with embodiments of the present invention, the antenna system includes a ground plane and a plurality of feeds separated from the ground plane by a dielectric. The ground plane can be planar, or can define a volume. The dielectric can define a shallow conical form that is centered on a center point. The feeds can be arranged symmetrically about the center point. Moreover, the feeds can be located along lines extending radially from the center point. A switch at the center point interconnects a selected feed or a selected plurality of feeds to a radio frequency bus. The radio frequency bus can in turn be interconnected to a transmitter, receiver or transceiver.

In accordance with further embodiments of the present invention, the antenna system includes a controller that provides control signals to the feed switch. The feed switch can comprise a radial switch. The antenna system can additionally include a direction indicator that provides information to the controller regarding a desired direction for a beam formed by the antenna system. A direction indicator can be part of an open or closed loop system.

Methods in accordance with embodiments of the present invention include disposing a plurality of feeds in a radial pattern about a center point, and separating the feeds from a ground plane with a dielectric. A desired beam azimuth angle is determined, and a first feed with an associated beam having a coverage area that includes the desired beam angle is selected. A feed switch is then operated to connect the first feed to a radio frequency bus. Methods in accordance with embodiments of the present invention can additionally include providing direction information concerning a relative direction of a control asset or tracking asset to a controller. The controller can in turn provide a control signal to the feed switch to cause the switch to operatively connect the feed with a beam coverage area in the direction of the asset to the radio frequency bus.

Additional features and advantages of embodiments of the disclosed invention will become more readily apparent from the following description, particularly when considered together with the accompanying drawings.

DETAILED DESCRIPTION

Figure 1:
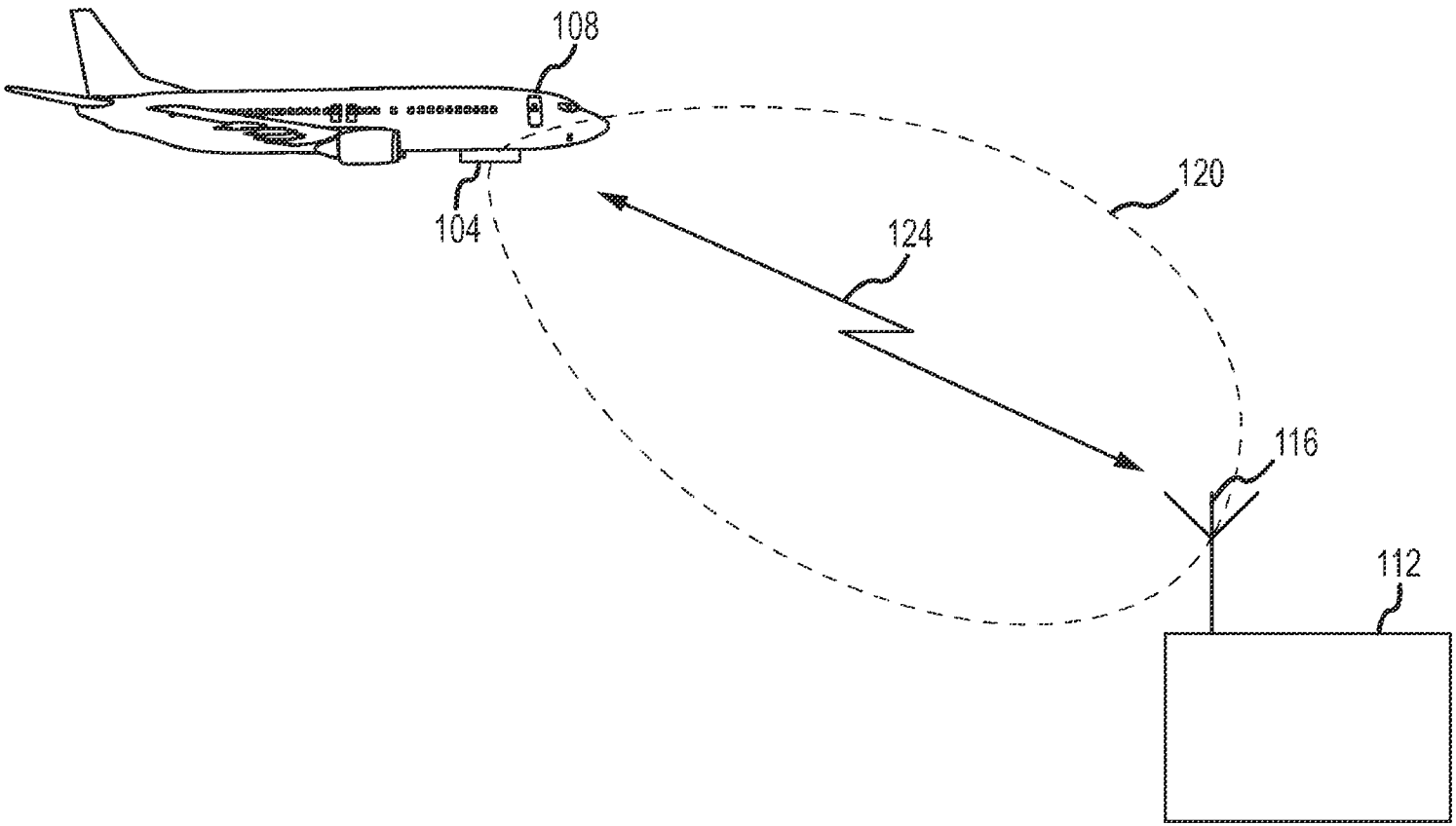
FIG. 1 depicts an antenna system in accordance with embodiments of the present invention in an exemplary operating environment.

FIG. 1 illustrates an antenna system 104 in accordance with embodiments of the present invention, in an exemplary operating environment. In particular, the antenna system 104 is shown mounted to a platform 108. In this example, the platform 108 comprises an airplane. However, an antenna system 104 in accordance with embodiments of the present invention can be associated with any type of platform 108, whether that platform 108 comprises a vehicle, stationary structure, or other platform. In general, the antenna system 104 operates to transmit and/or receive information relative to an endpoint 112. Moreover, the endpoint 112 can itself include or be associated with an endpoint antenna 116. Accordingly, data can be exchanged between the antenna system 104 and the endpoint antenna 116. Although the example environment illustrated in FIG. 1 depicts communications between two cooperating endpoints, embodiments of the present invention can also be used in other scenarios. For example, an antenna system 104 can be used as a sensor or beacon.

In one particular application, the antenna system 104 is used to receive control information from a ground station or endpoint 112 related to the operation of an associated platform 108. Alternatively or in addition, the antenna system 104 can be used to transmit telemetry information, environmental information, or information gathered from sensors mounted to the platform 108 to the endpoint 112. Moreover, in accordance with embodiments in which the platform 108 is moving relative to the endpoint 112, the ability of the antenna system 104 in accordance with embodiments of the present invention to steer an associated beam 120 is desirable. The beam 120 of the antenna system 104, which can, for example, support wireless transmission line 124, can be steered in at least one plane, to maximize or increase the gain of the antenna system 104 relative to the endpoint antenna 116. For example, the antenna system 104 can be mounted such that the beam 120 produced by the antenna system 104 can be steered in azimuth. Although depicted in the figure as a static element, as an alternative or in addition to a static element, the antenna 116 associated with the endpoint 112 can comprise an antenna system 104 in accordance with embodiments of the present invention, a phased array antenna system, a mechanically steered antenna system, or other antenna system.

Figure 2A:
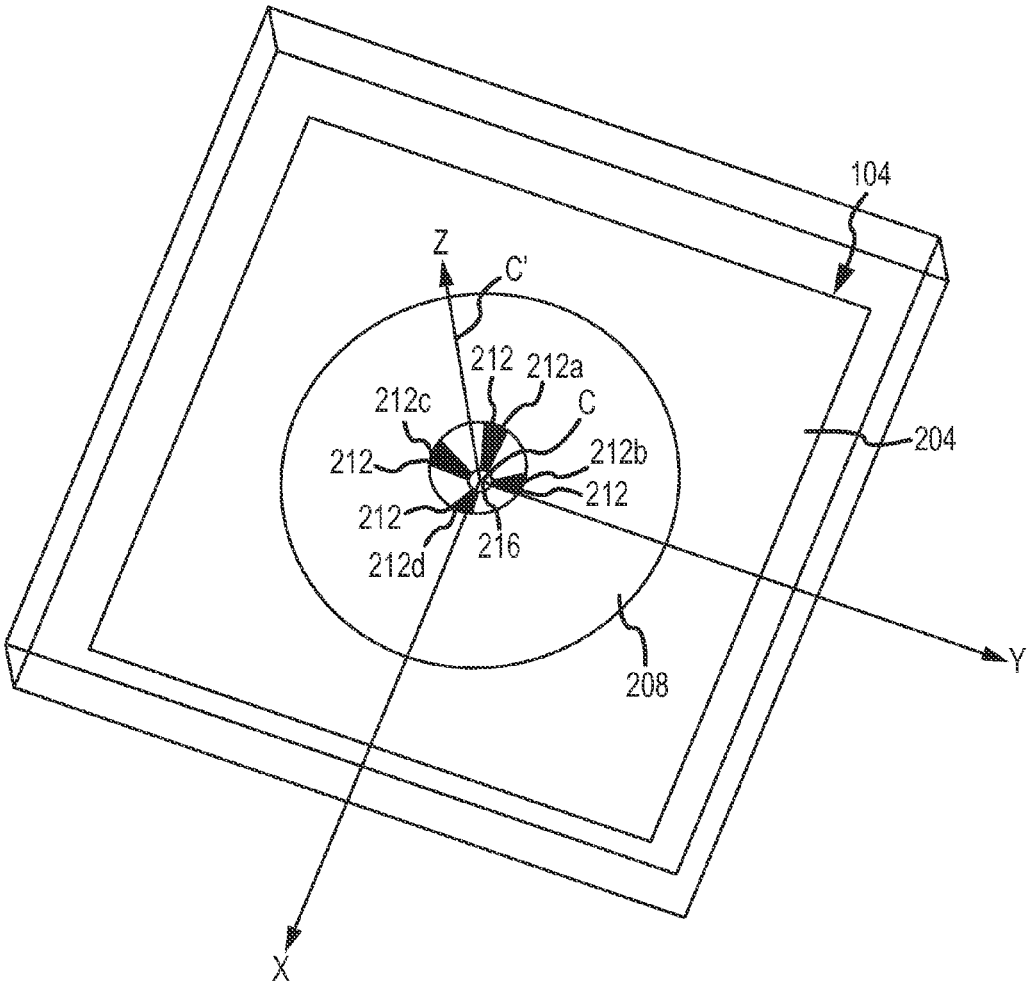
FIG. 2A is a perspective view of an antenna system in accordance with embodiments of the present invention.
Figure 2B:
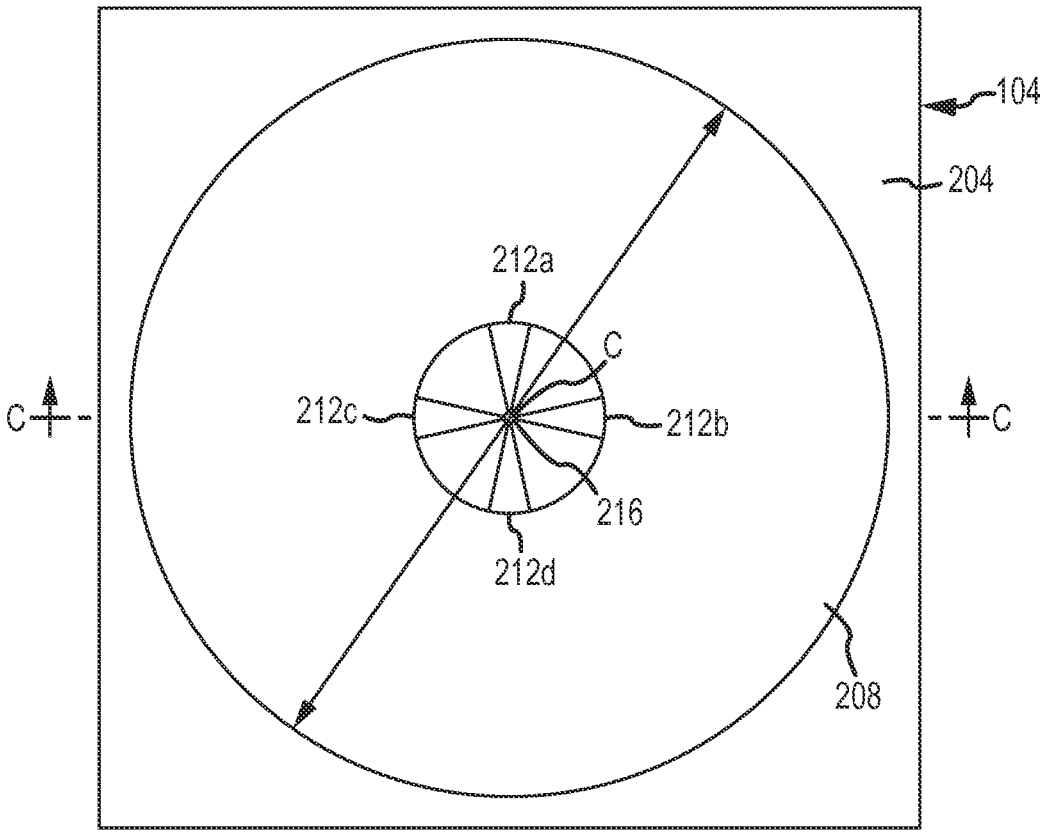
FIG. 2B is a plan view of the antenna system of FIG. 2A.
Figure 2C:
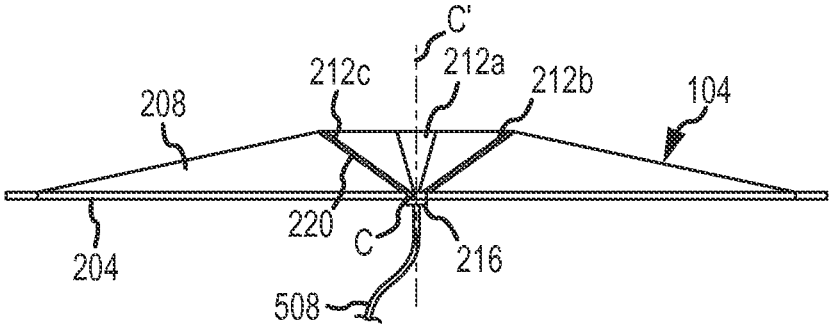
FIG. 2C is a cross-section in elevation of the antenna system of FIG. 2A.

FIGS. 2A-C depict an antenna system 104 in accordance with an exemplary embodiment of the present invention. In general, the antenna system 104 may have a circular configuration, according to which at least some of the components of the antenna system 104 are disposed symmetrically about a center point C, through which a central axis C' extends. FIG. 2A depicts the exemplary antenna system 104 in a perspective view. As shown, the antenna system 104 includes a ground plane 204, a dielectric 208, and a plurality of feeds 212. In this exemplary embodiment, the antenna system 104 comprises four feeds 212*a* to 212*d*. These feeds 212 are interconnected to a transceiver (not shown in FIG. 2A) by a radio frequency feed switch 216 located at the center point C and a radio frequency bus 508 that can connect to the feed switch 216 at the center point C.

FIG. 2B illustrates the antenna system 104 in plan view. In general, the feeds 212 are arranged in a radial pattern about the center point C. In addition, the feeds 212 are arranged radially about the switch 216. The dielectric 208 can provide physical support for the feeds 212 and can be configured to operate as a lens with respect to radio frequency energy passed between an operative feed 212 and the atmosphere. Moreover, as shown in the figure, the feeds 212 can be symmetric about the center point C, and can be arranged such that they are equidistant from one another. In accordance with alternate embodiments, the feeds 212 can be configured differently. For example, the spacing between adjacent feeds 212 can be varied.

FIG. 2C is a cross-section of the antenna system 104 taken along section line C-C of FIG. 2B. As shown in this figure, the dielectric 208 can provide a generally conical surface 220 that functions as a support surface for the feeds 212. In addition, the dielectric 208 can be configured to operate as a lens with respect to radio frequency energy passed between an operative feed 212 and the atmosphere. Moreover, the conical volume formed generally between the feeds 212, opposite the support surface 220, can be occupied by air, or by additional dielectric material other than air. In addition, as an alternative to a conic volume, the support surface 220 can comprise a surface that is described by an exponential curve as a body of rotation about the central axis C'. In particular, the support surface 220 form can be determined by antenna system 104 application pattern and bandwidth requirements. Accordingly, the support surface 220 can be any surface described by a line or curve as a body of rotation about the central axis C'.

Figure 3:
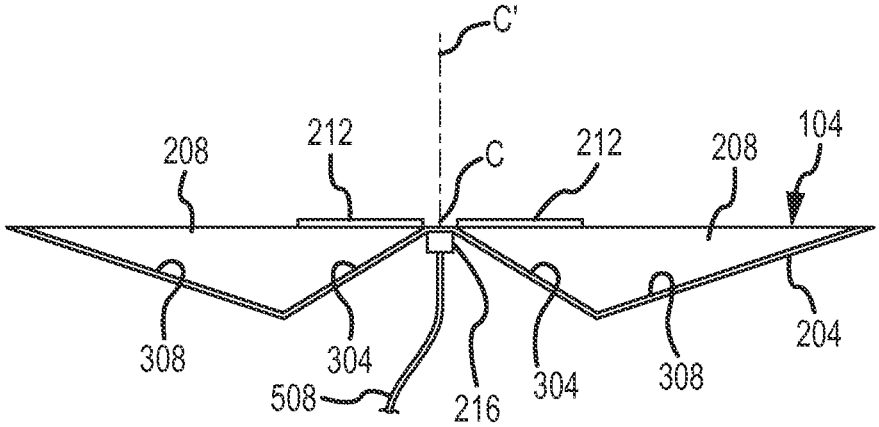
FIG. 3 is a cross-section in elevation of an antenna system in accordance with other embodiments of the present invention.

FIG. 3 depicts an antenna system 104 in accordance with further embodiments of the present invention. In this embodiment, the ground plane 204 is not confined to a planar configuration. More particularly, the ground plane 204 defines an annular volume with surfaces 304 and 308 that are angled with respect to the feeds 212. Moreover, the volume between the angled surfaces 304 and 308 of the ground plane 204 and the feeds 212 can be occupied by a dielectric material 208. The dielectric material 208 can provide a support surface for the feeds 212. As with other embodiments, the feeds 212 can be arranged symmetrically about the center point C, and the central axis C'. In addition, the feeds 212 can be arranged radially about the center point C and the central axis C'. A feed switch 216 is provided at the center point to operatively interconnect one or more of the feeds 212 to a transceiver (not shown in FIG. 3), via a radio frequency bus 508. Moreover, the feed switch 216 is configured to provide equidistant feed paths between each feed 212 and the transceiver.

Figure 4:
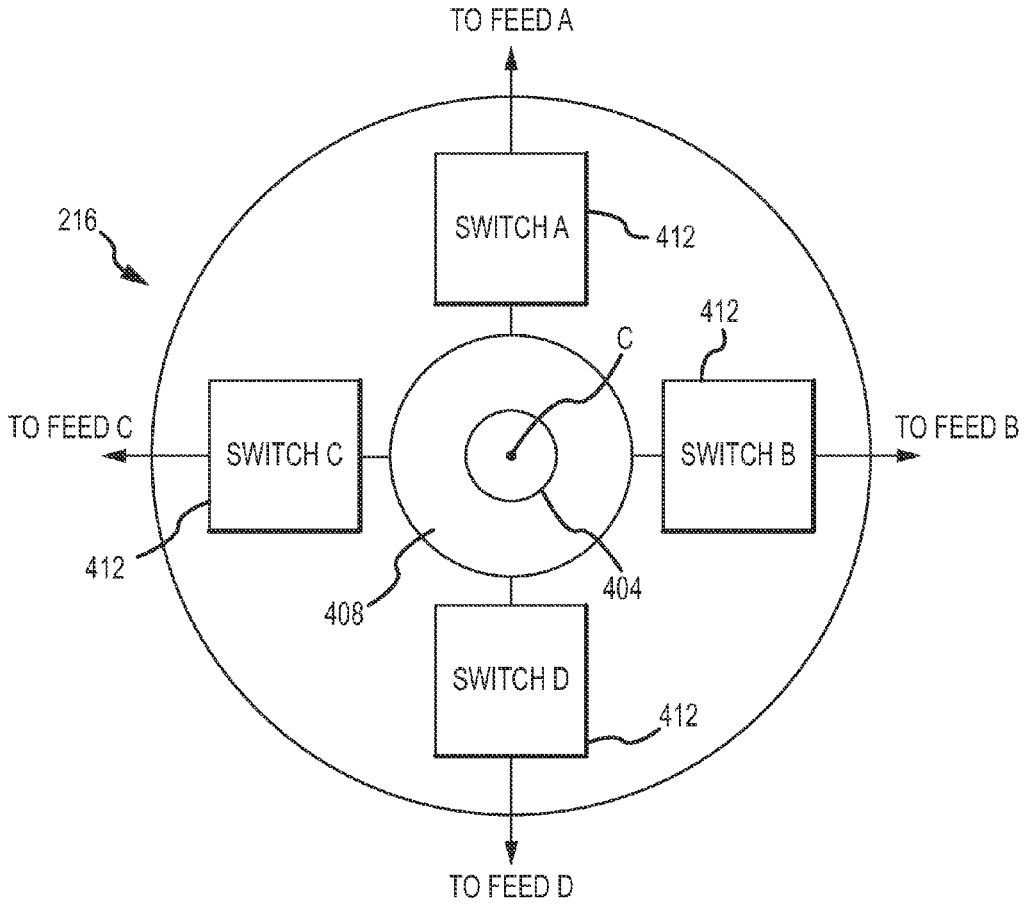
FIG. 4 depicts a feed switch of an antenna system in accordance with embodiments of the present invention.

FIG. 4 depicts a feed switch 216 in accordance with embodiments of the present invention. The feed switch 216 features a central feed point 404. The central feed point 404 may comprise, for example and without limitation, a coaxial connector that interconnects the switch 216 to a radio frequency bus 508 and in turn to a transceiver 510 (See FIG. 5). A distribution conductor 408 provides a signal path between the central feed point 404 and each of a plurality of feed element switches 412. As shown in the figure, the distribution conductor 408 may comprise a circular conductor surrounding the central feed point 404. Alternatively, or in addition, the distribution conductor 408 is non-circular, and/or is segmented, such that one distribution conductor 408 segment is provided for each feed element switch 412. In accordance with embodiments of the present invention, any configuration of the distribution conductor 408 provides equal length feed paths between the feed element switches 412 and the central feed point 404. In accordance with further embodiments of the present invention the number of feed element switches 412 is equal to the number of feeds 212. In addition, each feed element switch 412 is operated in response to control information received from a controller 512 (See FIG. 5). In particular, a selected feed element switch 412 can be closed, to operatively interconnect an associated feed 212 to the center conductor 404 at a particular point in time. In accordance with further embodiments, two or more switches 412 may be closed simultaneously at a particular point in time. The central feed point 404 may be centered on the centerpoint C of the antenna system 104. Accordingly, the switch 216, which may be described as a radial switch, is centered between the feeds 212, such that the length of the signal paths between the central feed point 404 and the feeds 212 are the same for each feed 212.

As can be appreciated by one of skill in the art after consideration of the present disclosure, by operating a selected feed 212, a beam 120 can be steered in a selected direction in azimuth. In particular, the geometry of the individual feeds 212 with respect to the ground plane 204 and the associated dielectric 208 provides a directional beam pattern. Moreover, by changing the feed 212 that is operable, the direction of the beam produced by the antenna system 104 can be changed. This change in direction is accomplished without requiring mechanical steering of any kind. Moreover, an antenna system 104 in accordance with embodiments of the present invention in effect provides a series of Doorstop™ antennas arranged radially about the center point C. The characteristics of the dielectric 208, particularly in regions generally between a feed 212 and adjacent portions of the ground plane 208, can be configured to provide a desired lens effect with respect to a beam produced in association with the feeds 212.

Figure 5:
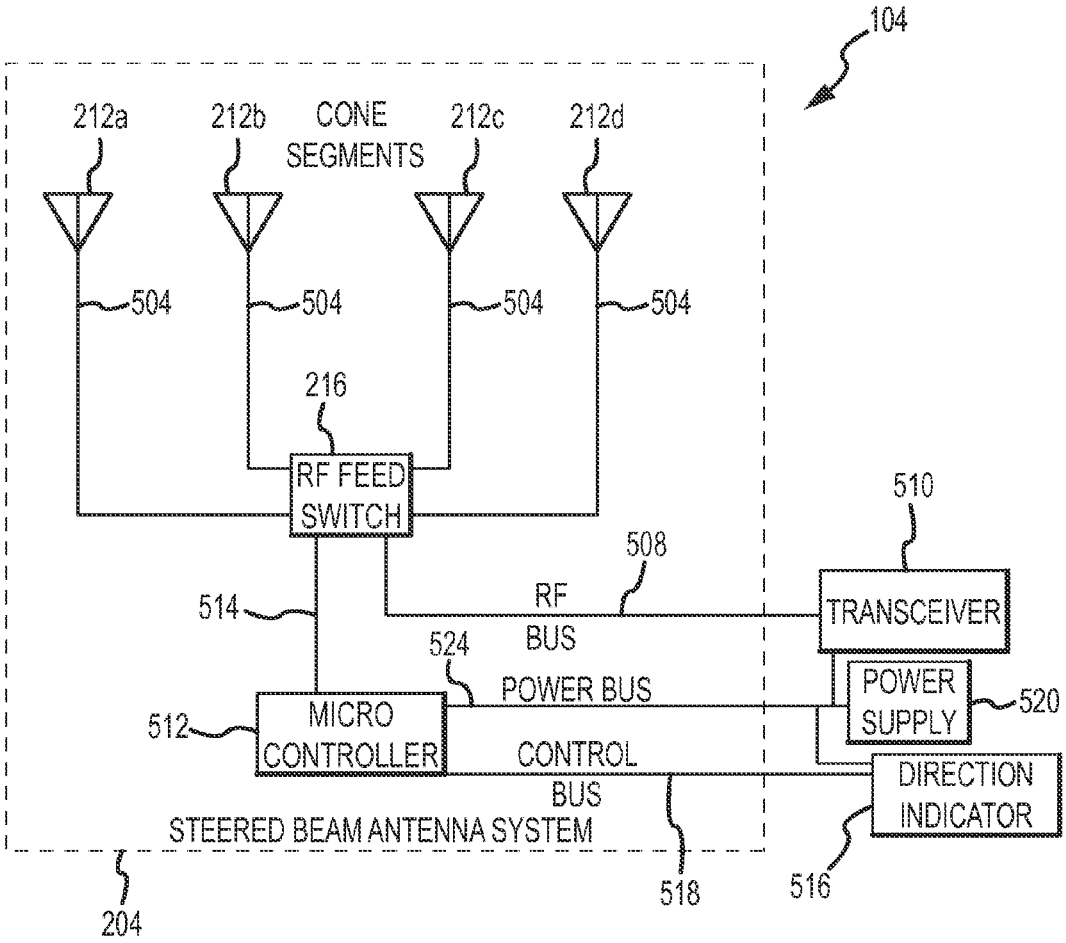
FIG. 5 is a block diagram of components of an antenna system in accordance with embodiments of the present invention.

FIG. 5 is a block diagram depicting components of an antenna system 104 in accordance with embodiments of the present invention. Each of the feeds 212 is interconnected to the radio frequency feed switch 216 by a radio frequency (RF) signal line 504. Alternatively, each feed 212 may be directly connected to the feed switch 216. For example, each feed can be directly connected to a port of an associated feed element switch 412 included in the feed switch 216. The radio frequency feed element switch 216 can be operated to interconnect a selected feed 212 to a radio frequency (RF) bus 508, that provides a signal from (or to) a transmitter, receiver or transceiver 510, hereinafter referred to as a transceiver. In accordance with embodiments of the present invention, the feed switch 216 and the radio frequency signal lines 504, if any, are configured to provide equal length signal paths between the RF bus 508 and the feeds 212. Operation of the feed switch 216 can be in response to a control signal provided by a controller 512 over a control signal line 514. The controller 512 can receive input from a direction indicator 516 delivered by a control bus 518. In general, a direction indicator 516 operates to provide information regarding the direction in which a beam 120 produced by the antenna system 104 should be pointed. Power can be provided to components of the antenna system 104 from a power supply 520 by a power distribution bus 524.

In accordance with embodiments of the present invention, various components may be mounted to and/or associated with the ground plane 204, while other components may be separate from the ground plane 204. For example, the feeds 212 are generally interconnected to the ground plane 204 by the dielectric 208 (see FIGS. 2A-2C and 3), and the feed switch 216 is also generally interconnected to the ground plane 208 such that it is located at a center point between the radially configured feeds 212. As shown in the figure, the controller 512 can also be interconnected to the ground plane 204, for example via the switch 216. In the example of FIG. 5, the transceiver 510, direction indicator 516, and power supply 520 are all located separate from the ground plane 204. For example, components that are separate from the ground plane 204 can be located in and/or mounted to portions of a platform 108 that are separate from the ground plane 204.

In accordance with embodiments of the present invention, the dielectric 208 can comprise a polycarbonate or other dielectric material, and the feeds 212 can comprise metallic traces formed on and/or supported by the surface of the dielectric 208. The radio frequency switch 216 can comprise a monolithic microwave integrated circuit (MMIC). A transceiver 510 can include a radio frequency transmitter, radio frequency receiver, radio frequency transceiver, power electronics, and the like. The controller 512 can comprise a microcontroller, programmable processor, or other device capable of receiving direction information from a direction indicator 516, and capable of operating the feed switch 216 in response to a signal from the direction indicator 516. In accordance with still other embodiments, the controller 512 can receive signal level information from the transceiver 510, in place of or in addition to signals from a direction indicator 516, in order to determine which feed 212 should be interconnected to the transceiver 508 by the feed switch 216, and thus the direction in which the beam 120 produced by the antenna system 104 should be pointed. A direction indicator 516 can comprise a global positioning system receiver, inertial navigation system, compass or equivalent function vehicle navigation system. Moreover, although the controller 512 can comprise a programmable processor running application software for implementing a steering and feed switch 216 control algorithm, the controller 512 can also comprise a low cost microcontroller running firmware or simple operating instructions. The ground plane 204 can comprise an electrically conductive plate, such as a metal or metalized surface that is provided separately or that is integral to an associated platform 108.

Figure 6:
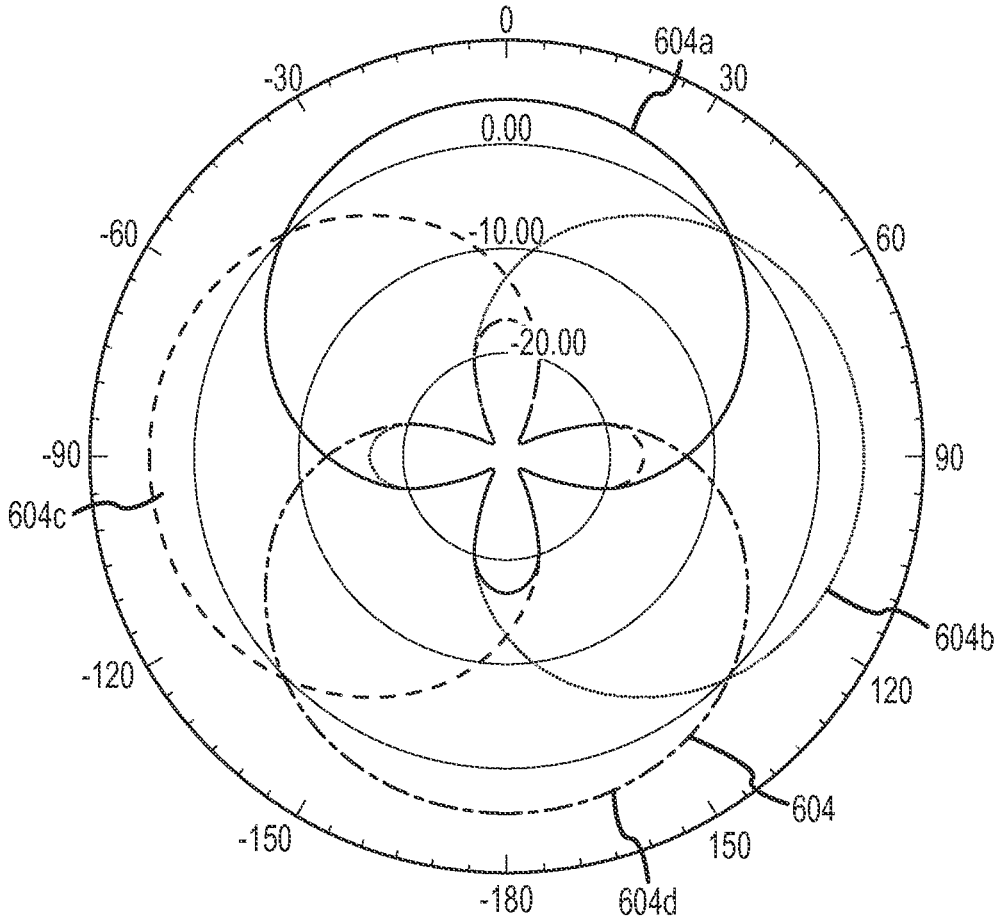
FIG. 6 depicts single feed azimuth patterns for a beam steered in azimuth.

FIG. 6 depicts single feed azimuth patterns 604 for a beam 120 produced by an antenna system 104 in accordance with an exemplary embodiment of the present invention that is steered in azimuth. In particular, a first pattern **604*a* is produced by operating the feed switch 216 such that the first feed element 212*a* is interconnected to the transceiver 508. Likewise, a second beam pattern 604*b* is formed by interconnecting the second feed element 212*b* to the transceiver 508, a third beam pattern 604*c* is produced by interconnecting the third feed element 212*c* to the transceiver 508, while a fourth beam pattern 604*d* is formed by interconnecting the fourth feed element 212*d* to the transceiver 508. From this collection of beam patterns 604, it can be appreciated that by selectively operating one of the feed elements 212 in the antenna system 104, the gain provided by the antenna system 104 in any selected direction in azimuth with respect to the antenna system 104 is substantially the same. In addition, it can be appreciated that the gain in a direction other than the quadrant towards which the beam pattern 604 being produced is pointed is relatively small. Accordingly, the production of a beam in directions other than the quadrant encompassing the desired direction is relatively small. As can be appreciated by one of skill in the art, such directivity can be advantageous, for example in applications in which it is desirable to minimize power consumption for a given amount of gain. As a further example, the ability to steer the beam 120** can be advantageous, where it is desirable to avoid potential electronic intelligence (ELINT) and electronic counter measures (ECM) threats or ambient radio frequency interference.

Figure 7:
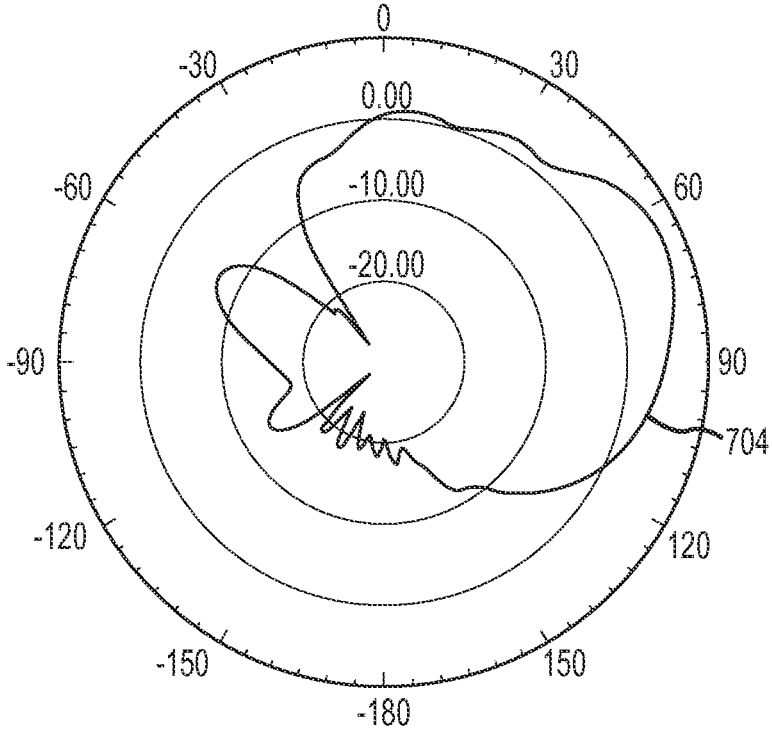
FIG. 7 depicts a single feed elevation pattern.

FIG. 7 depicts a single feed elevation pattern 704 for an exemplary antenna system 104 in accordance with embodiments of the present invention. As can be appreciated from this exemplary pattern, the beam 120 produced by an antenna system 104 in accordance with embodiments of the present invention produces a pattern 704 that peaks off the plane (horizon) of the ground plane 204. The pattern 704 additionally exhibits useful gain at the zenith. As a result, if the antenna system 104 were mounted on the underbelly of a platform 108 comprising an air vehicle, the elevation pattern 704 coverage is without the pattern null that occurs using a monopole style element.

Figure 8:
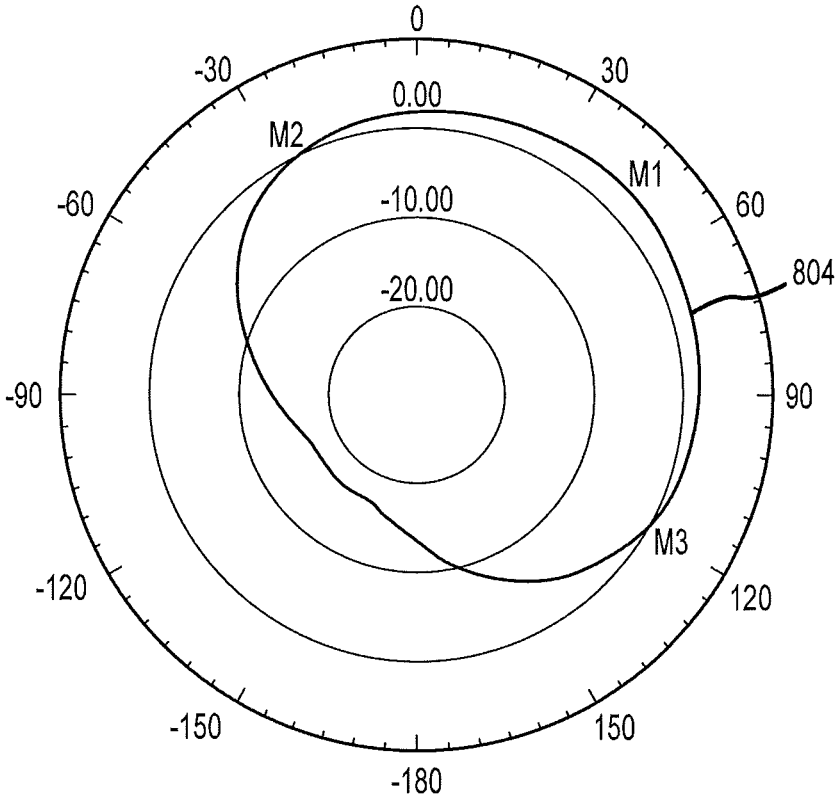
FIG. 8 depicts a dual feed azimuth pattern.

In accordance with further embodiments of the present invention, multiple feed elements 212 can be operated simultaneously. An example of a beam pattern 804 produced by operating two adjacent feed elements 212 simultaneously is illustrated in FIG. 8. In this example, feed elements 212*a* and 212*b* (see FIGS. 2A and 2B) are operated simultaneously. As can be appreciated from this example, operating two adjacent feed elements 212 simultaneously can provide a beam pattern 804 that provides even gain over a wide range of azimuth angles, while continuing to exhibit relatively low side lobe levels. Beam pattern 804 provides improved gain at the azimuth crossover angle between beams from feed elements 212*a* and 212*b* operated individually.

Figure 9:
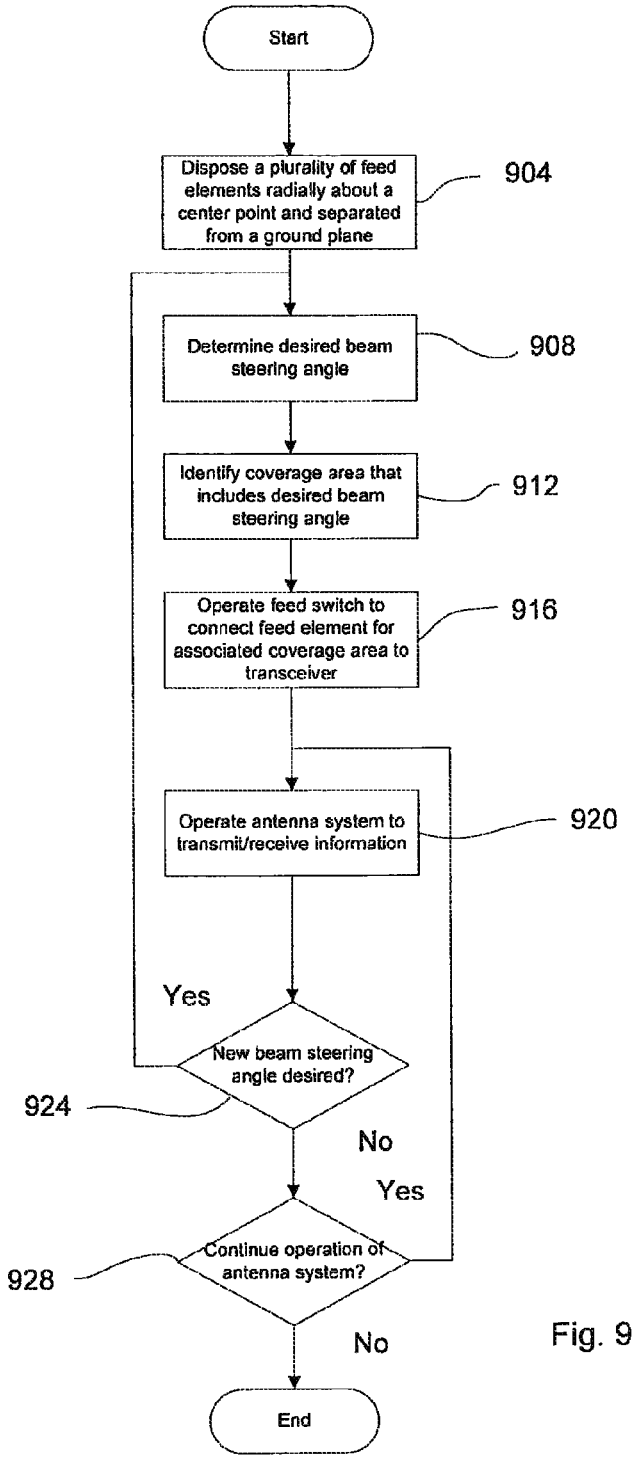
FIG. 9 depicts aspects of a method in accordance with embodiments of the present invention.

FIG. 9 depicts aspects of a method for producing an antenna beam 120 in a desired direction in accordance with embodiments of the present invention. Initially, at step 904, a plurality of feed elements 212 are disposed radially about a center point C and such that they are separated from a ground plane 204. The feed elements 212 can be supported by a dielectric 208. Moreover, the lengths of the individual feed elements 212, and the angle at which the feed elements are positioned relative to the ground plane 204, at least in an area adjacent to each feed element 212, can be selected according to the performance requirements of the antenna system 104. The dielectric 208 can also be selected and configured to provide a desired lensing effect.

At step 908, the desired beam 120 steering angle is determined. In accordance with embodiments of the present invention, the desired beam 120 steering angle can be determined by a controller 512 in response to direction information provided by a direction indicator 516, such as a global positioning system receiver or other direction or bearing indicating device. Alternatively or in addition, direction indication information can be provided by the transceiver 510 in the form of signal strength information. As can be appreciated by one of skill in the art after consideration of the present disclosure, a signal from a global positioning system receiver or other device that indicates or that provides information that can be used to determine the desired steering angle are examples of direction information that can be used to implement an open loop beam 120 steering technique. As can also be appreciated by one of skill in the art after consideration of the present disclosure, direction information provided in the form of signal levels provided by a transceiver 908 is an example of a closed loop beam 120 steering technique.

From the desired beam steering angle information, the coverage area that includes the desired beam 120 steering angle can be identified (step 912). In particular, for an implementation in which a single feed element 212 is operated at any one point in time, the feed element 212 having a coverage area or beam pattern 604 that includes the desired beam 120 steering angle can be selected by the controller 512 for operation. In accordance with other embodiments, for example where two adjacent feed elements 212 are operated simultaneously, the feed elements 212 that are closest to a desired beam steering angle can be selected for operation. At step 916, the controller 512 operates the feed switch 216 to connect the feed element 212 for the associated coverage area to the transceiver 510. The antenna system 104 can then be operated to transmit and/or receive information (step 920).

At step 924, a determination may be made as to whether a new beam 120 steering angle is desired. For example, where the antenna system 104 is mounted to a mobile platform 108, and/or where the antenna system 104 moves relative to a control asset, such as a cooperating antenna 116, or relative to a tracking asset, a new beam 120 steering angle may be needed to provide adequate gain. If a new beam 120 steering angle is desired, the process may return to step 908. At step 928, a determination may be made as to whether the operation of the antenna system 104 should be continued. Although shown as being performed after determining that a new beam steering angle is not desired, it should be appreciated that a decision regarding the continued operation of the antenna system 104 can, in accordance with embodiments of the present invention, be made at any time during operation of the antenna system 104. If operation of the antenna system 104 is to be continued, the process can return to step 920. If operation of the antenna system 104 is to be discontinued, the process may end.

As described herein, an antenna system 104 in accordance with embodiments of the present invention can provide a beam 120 that is steered within a plane perpendicular to the central axis C' of the antenna system 104. That is, the beam 120 can be steered in azimuth. Moreover, an antenna system 104 in accordance with embodiments of the present invention provides steering by selectively activating one or more of a plurality of feed elements 212 arranged radially about the central axis C' of the antenna system 104.

As will be apparent to one of skill in the art after consideration of the present disclosure, embodiments of the present invention have particular application in connection with antenna systems 104 associated with mobile platforms 108, and/or with antenna systems 104 in communication with endpoints 112 that move relative to the antenna system 104. For example, an antenna system 104 can be deployed in connection with a platform 108 comprising an unmanned aerial vehicle, and can operate to track a stationary endpoint antenna 116 that provides control information to such a vehicle 108, and that receives information from such a vehicle 108. An antenna system 104 in accordance with embodiments of the present invention can, as shown in various illustrated embodiments, include four feed elements 212. In accordance with alternate embodiments, different numbers of feed elements 212 can be utilized. Moreover, as can be appreciated by one of skill in the art after consideration of the present disclosure, antenna systems 104 in accordance with embodiments of the present invention can include feed elements 212 that are supported by and/or interconnected to a support surface 220 described by a line or a curve as a body of rotation about the central axis C', including but not limited to a conical or disk shaped dielectric 208, or a faceted dielectric 208.

In an exemplary embodiment that provides a voltage standing wave ratio of 2:1 and that has an operating frequency range of from 4 to 6 GHZ, the ground plane 204 is in fact a planar element, at least in areas adjacent the feed elements 112. In addition, the dielectric disk or cone 208 has an aperture surrounding the center point C with a diameter of about 0.1 inch. This aperture can admit a common feed conductor or RF bus 508 that interconnects to a feed switch 216. Alternatively, the center aperture can provide clearance for individual RF signal lines 504 that extend from a feed switch 216 located on a side of the ground plane 204 opposite the side that the feed elements 212 are adjacent. The dielectric 208 can provide a support portion 220 that is at an angle of about 35° with respect to the ground plane 204. Moreover, the maximum diameter of the support surface 220 can be about 2 inches, providing for a peak distance from the ground plane 204 to the thickest part of the dielectric 208 of about 0.7 inches. The dielectric 208 may have a maximum diameter of about 8 inches. Accordingly, it can be appreciated that an antenna system 104 in accordance with embodiments of the present invention can be considered a low profile antenna.

In accordance with other embodiments, the feed elements 212 can be radially arranged about the central axis C' of the antenna system 104, and contained within a common plane. In such embodiments, the ground plane 208 can be sloped with respect to the feed elements 212. Accordingly, the ground plane 204 can define a volume that in cross-section provides two opposed wedges. As can be appreciated by one of skill in the art after consideration of the present disclosure, two opposed Doorstop™ or embedded surface wave antenna elements are provided for each opposed pair of feed elements 212. In addition, although particular embodiments have been illustrated having feed elements 212 in the form of segments, other configurations and shapes of feed elements 212 and dielectric 104 can be used.

Although embodiments in which one or two feed elements 212 are operated simultaneously to provide coverage over a desired steering angle are described, other configurations are possible in accordance with embodiments of the present invention. For example, a first feed element 212 can be selected for coverage of a steering angle associated with a first tracking or control asset, while a second feed element 212, at a different angular location with respect to the first feed element 212, can be selected for coverage of a steering angle associated with a second tracking or control asset.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna system, comprising:

a ground plane;

a dielectric, wherein the dielectric is interconnected to the ground plane, wherein the dielectric comprises a conical surface, and wherein the conical surface is centered on a center point ;

a plurality of feeds, wherein the plurality of feeds are:

located on the conical surface of the dielectric;

symmetrical about the center point;

located at intervals about the dielectric;

inclined with respect to the ground plane;

a feed switch, wherein the feed switch is operable to connect a selected one of the feeds included in the plurality of feeds to a feed channel.

2. The antenna system of claim 1, wherein the feed switch includes a central distribution point centered on the center point.

3. The antenna system of claim 2, wherein the central distribution point is equidistant from each feed included in the plurality of feeds.

4. The antenna system of claim, 1, wherein the dielectric is between the plurality of feeds and the ground plane.

5. The antenna system of claim 1, wherein, the feed switch is a radial switch, and wherein the feed switch includes a number of feed element switches equal to a number of feeds included in the plurality of feeds.

6. The antenna system of claim 1, wherein the ground plane defines a volume, and wherein the volume is substantially filled by the dielectric.

7. The antenna system of claim 1, wherein the plurality of feeds includes four planar feeds, and wherein the four planar feeds are supported by the dielectric.

8. An antenna system, comprising:

a ground plane;

a dielectric interconnected to the ground plane, wherein the dielectric includes a conical support surface centered on a center point;

a plurality of feeds, wherein each of the feeds included in the plurality of feeds is disposed on the conical support surface radially about the center point, and wherein each of the feeds is inclined with respect to the ground plane;

a feed switch wherein the feed switch is located at the center point, and wherein the feed switch is operable to interconnect at least a selected one of the feeds included in the plurality of feeds to a radio frequency bus.

9. The antenna system of claim 8, further comprising:

a transceiver, wherein the transceiver is interconnected to the feed switch by the radio frequency bus.

10. The antenna system of claim 8, further comprising:

a controller, wherein the controller is interconnected to the feed switch to supply the feed switch with a control signal to operate the feed switch such that the at least a selected one of the plurality of feeds is interconnected to the radio frequency bus by the feed switch.

11. The antenna system of claim 10, further comprising:

a control bus, wherein direction data is provided to the controller over the control bus, and wherein the controller uses the direction data to determine the control signal to send to the feed switch.

12. The antenna system of claim 11, further comprising:

a direction indicator, wherein the direction data is provided to the controller from the direction indicator over the control bus.

* * * * *